US008418281B2

(12) United States Patent
Sutter

(10) Patent No.: US 8,418,281 B2
(45) Date of Patent: Apr. 16, 2013

(54) UNDERMOUNT SINK SEAL AND METHOD OF MAKING

(75) Inventor: John Norman Sutter, Portland, OR (US)

(73) Assignee: Undermount LLC, Portland, OR (US)

( * ) Notice: Subject to any disclaimer, the term of this patent is extended or adjusted under 35 U.S.C. 154(b) by 0 days.

(21) Appl. No.: 13/152,980

(22) Filed: Jun. 3, 2011

(65) Prior Publication Data

US 2012/0306165 A1 Dec. 6, 2012

(51) Int. Cl.
*E03C 1/33* (2006.01)

(52) U.S. Cl.
USPC ..... 4/631; 4/619; 4/632

(58) Field of Classification Search ..... 4/631–636, 4/637, 506, 643, 619; 277/644, 647, 637, 277/921
See application file for complete search history.

(56) References Cited

U.S. PATENT DOCUMENTS

| | | | | |
|---|---|---|---|---|
| 2,080,573 | A * | 5/1937 | Madsen | 4/631 |
| 2,158,467 | A * | 5/1939 | Madsen | 4/631 |
| 2,397,690 | A * | 4/1946 | Pawlus et al. | 4/650 |
| 4,374,695 | A * | 2/1983 | Ikeda et al. | 156/293 |
| 6,986,174 | B2 * | 1/2006 | Brown | 4/631 |
| 7,007,317 | B1 * | 3/2006 | Brown | 4/631 |
| 2009/0139076 | A1 * | 6/2009 | Ramamurthy et al. | 29/527.1 |

* cited by examiner

*Primary Examiner* — Gregory Huson
*Assistant Examiner* — Erin Deery
(74) *Attorney, Agent, or Firm* — Mark S Hubert

(57) ABSTRACT

An under counter mount sink sealing surface and method of making that provides a watertight interface between an under counter mount sink and a laminate counter as well as a simplified and more dimensionally accurate method of field installing the sink below the counter. The water impervious seal is tightly chemically bonded to the cutout lip of the laminate as well as to the entire area on the bottom face of the laminate countertop that contacts the entire profile of the top face of the under counter mount sink. The seal also aligns the sink into the correct location and contacts the entire surface of the as it is deck aligned or completely parallel to the sink top flange.

8 Claims, 9 Drawing Sheets

FIG. 9
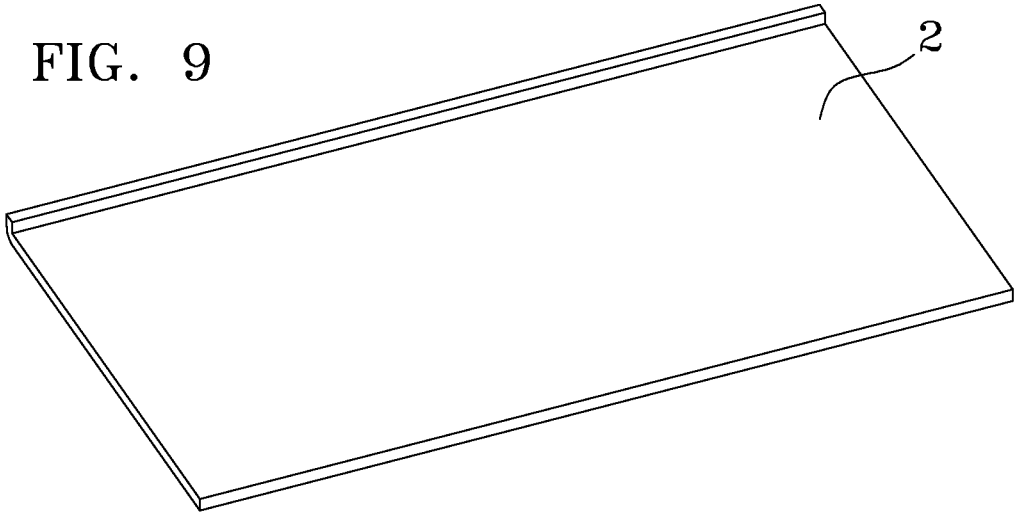
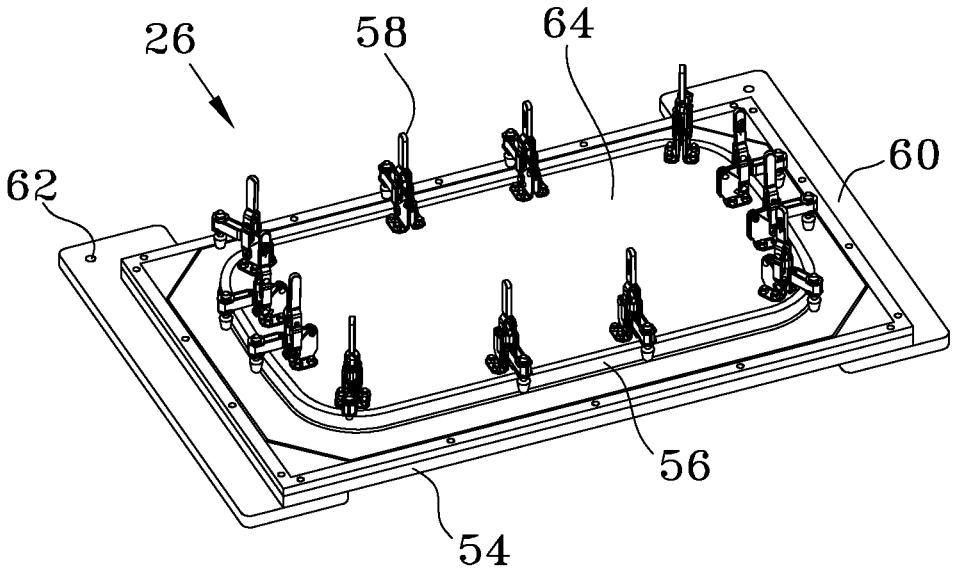
FIG. 10

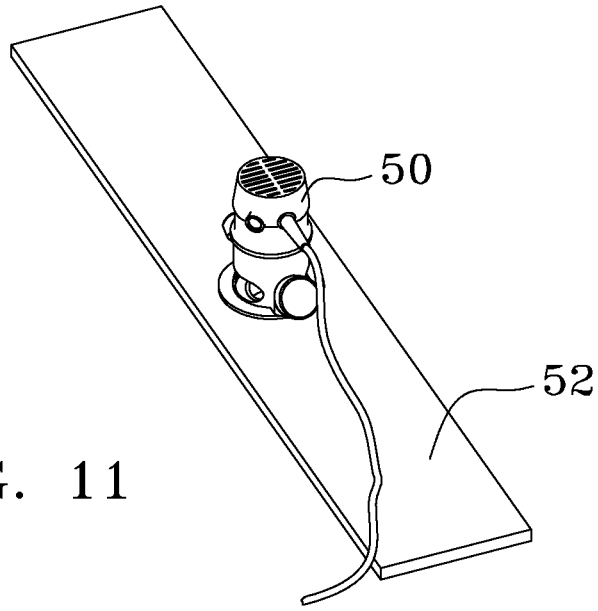
FIG. 11
FIG. 12
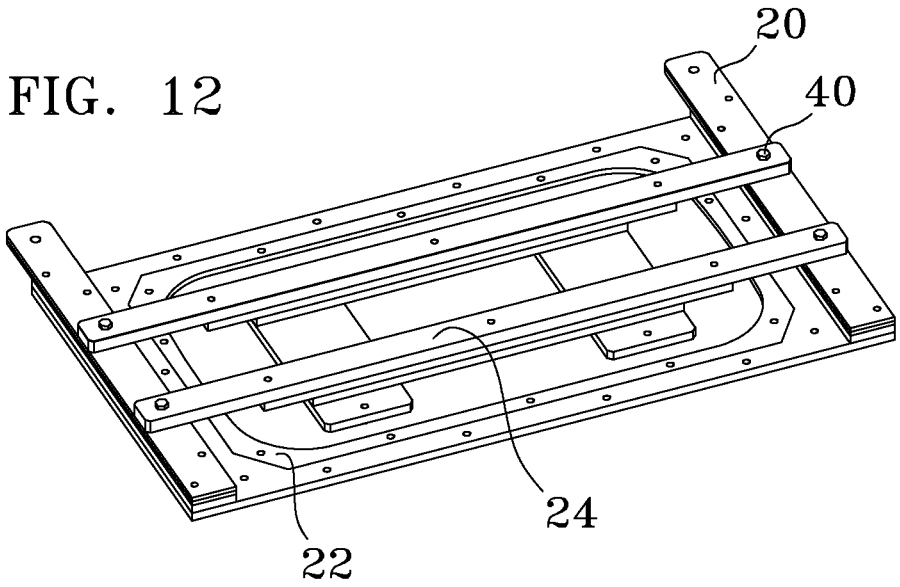

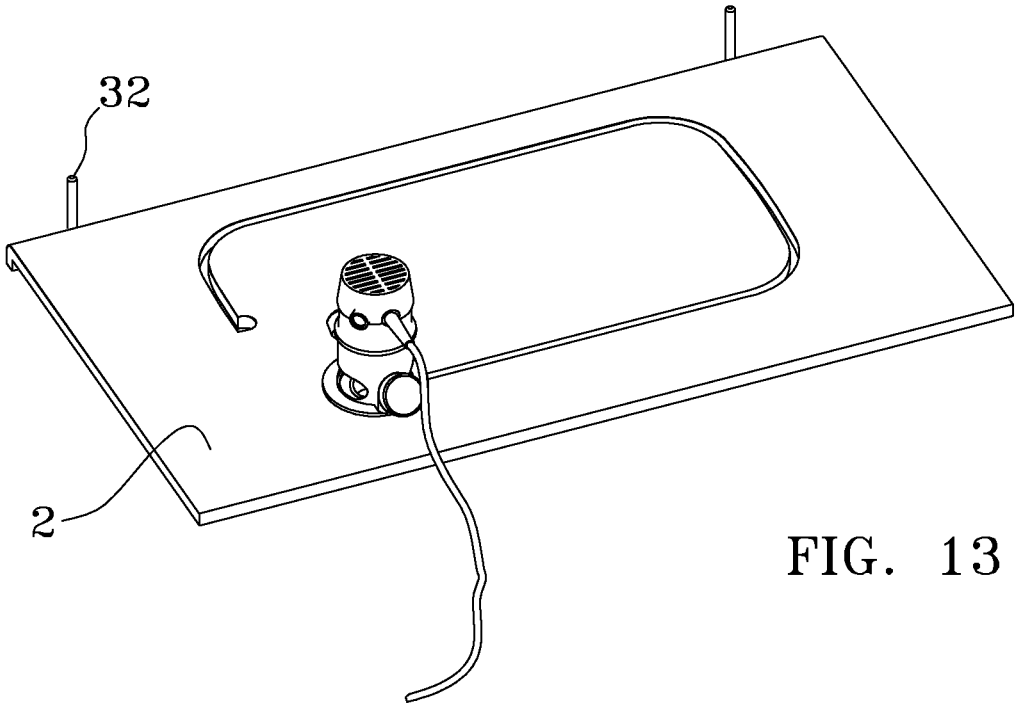
FIG. 13
FIG. 14
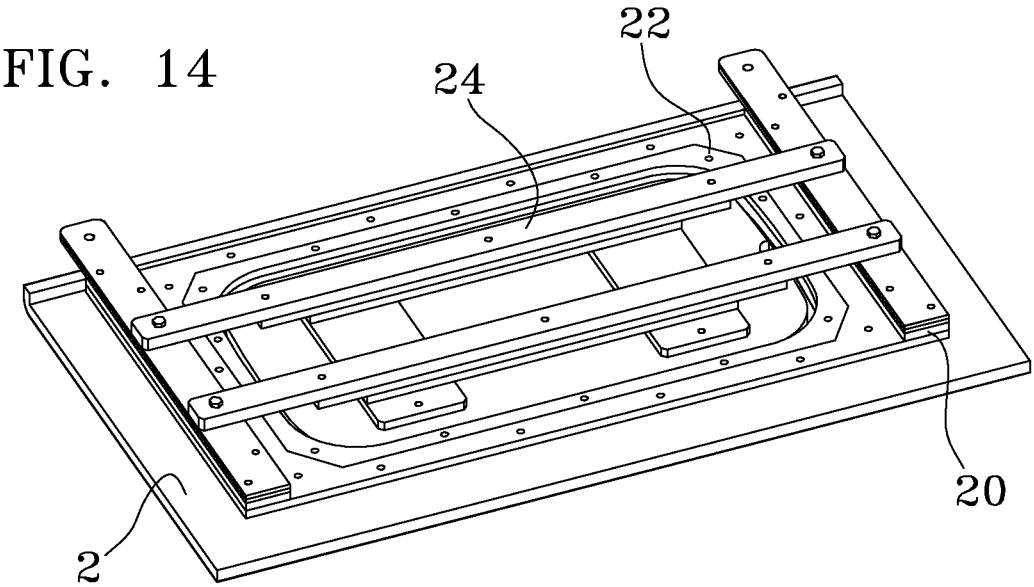

UNDERMOUNT SINK SEAL AND METHOD OF MAKING

BACKGROUND OF THE INVENTION

The present invention relates to a watertight seal made between the interface of a sink and the laminate counter which it is mounted underneath. It provides both an aesthetically pleasing alternative to conventional undermounted sinks and also provides a much user friendly and dimensionally precise method of on-site installation.

The countertop industry has seen a shift from the standard laminate countertops with top mount stainless steel (or other material) sinks to solid surface countertops with undermount stainless steel, porcelain or polymer sinks. Under counter mount sinks are more desirable than top mount sinks because there is no lip on top of the counter to catch debris and stain. Further they prevent the continuous wiping of the counter into the sink. Man made and natural solid surface countertops lend themselves better to under counter mount sinks than do laminate countertops because of their solid construction. When water contacts the sides of a laminate countertop the glued wood particle makeup absorbs water, swells and eventually deteriorates and crumbles away. The point of failure (where this water substrate contact occurs) in the prior art generally occurs at interface at the bottom edge of the laminate and the sink seal. In top mounted sinks the water can seep under the sink top flange and the laminate and run down between the sink and the particle board substrate. Thus solid surface countertops have dominated the market where under counter mounted sinks are desired.

The solution for the laminate countertop is to have a seal that prevents the deterioration of the laminate substrate by preventing water from ever contacting it. Of course it must also be aesthetically pleasing.

Henceforth, a visually appealing sealing interface between an undermount sink and a laminate countertop would fulfill a long felt need in the building industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a sealing interface between an under counter mount sink and a laminate counter as well as a simplified and more dimensionally accurate method of field installing the sink below the counter. The key concept of accomplishing a water impervious seal between an under counter mount sink and a laminate countertop is to provide a seal that is tightly, directly, chemically bonded to the cutout lip of the laminate and the sink cutout edge in the particle board substrate as well as to the entire area on the bottom face of the laminate countertop's particle board substrate that contacts the top face of the under counter mount sink. In this way there is never the possibility of water contacting an unprotected area of the countertop substrate. Critical to accomplishing this are two other key concepts: aligning the sink onto the seal correctly and ensuring that the seal face that contacts the top flange of the sink is deck aligned or completely parallel to the sink top flange.

The undermount sink seal of the present invention has many of the advantages mentioned heretofore and many novel features that result in a new system for mounting an under counter mount sink to a laminate countertop which is not anticipated, rendered obvious, suggested, or even implied by any of the prior art, either alone or in any combination thereof.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

BRIEF DESCRIPTION OF THE DRAWINGS

FIG. 9 is a top perspective view of an inverted laminate countertop;

FIG. 10 is a top perspective view of the sink seal mold;

FIG. 11 is a top perspective view of the surface routing assembly;

FIG. 12 is a top perspective view of the locator/dam ring with the hole routing jig and the countertop cutout support jig installed;

FIG. 13 is a top perspective of the countertop sink cutout being routed out from the top side of the countertop;

FIG. 14 is a top perspective view of an inverted countertop with the locator/dam ring, the hole routing jig and the countertop cutout support jig installed;

DETAILED DESCRIPTION

Figure 1:
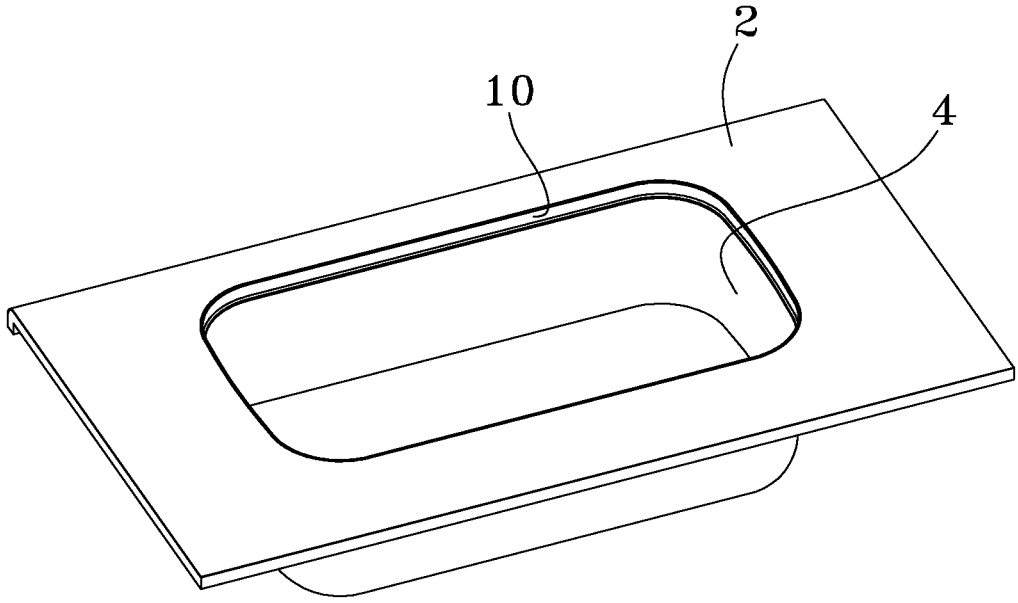
FIG. 1 is a front perspective view of the under counter mount sink sealing system showing an under counter mounted sink mated to a countertop with the sealing interface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Figure 2:
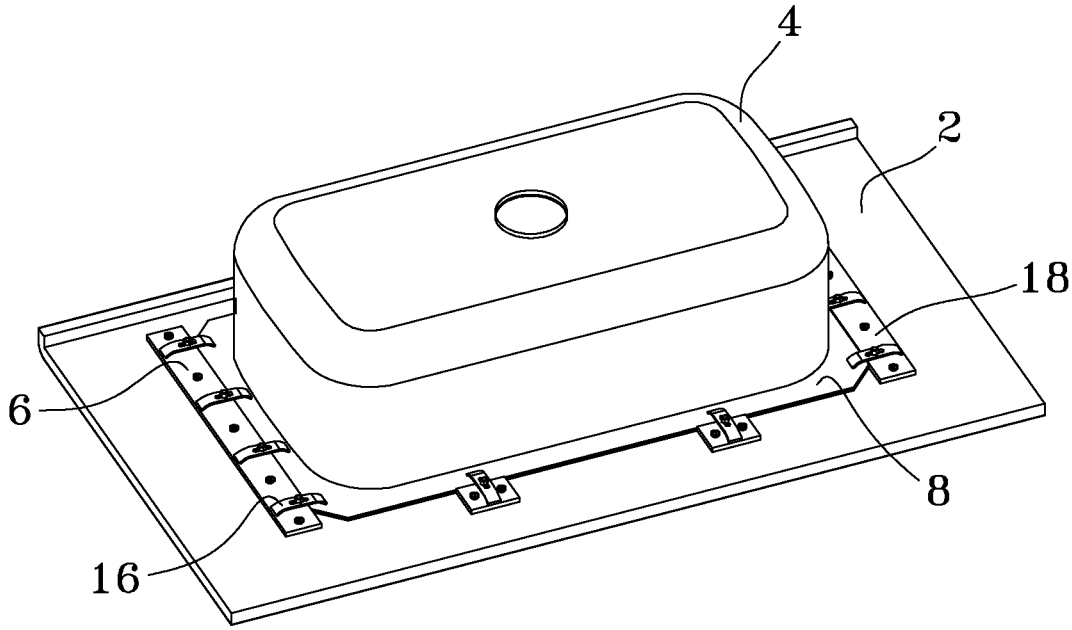
FIG. 2 is a bottom perspective view of the under counter mount sink sealing system showing the clamping assembly.
Figure 8:
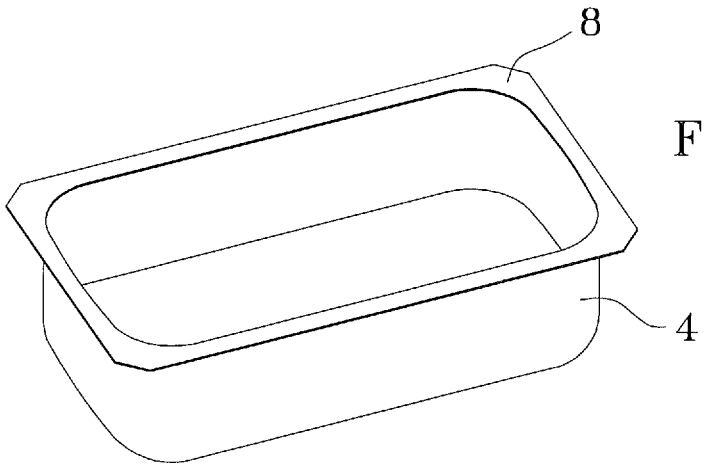
FIG. 8 is a top perspective view of an under counter mount sink.
Figure 15:
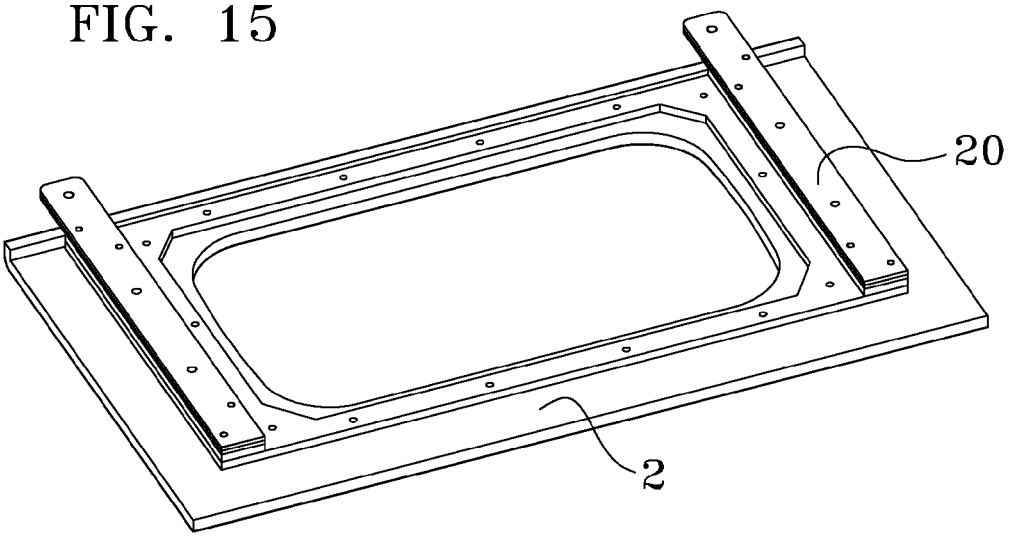
FIG. 15 is a top perspective of an inverted countertop with the locator/dam ring installed thereon.
Figure 16:
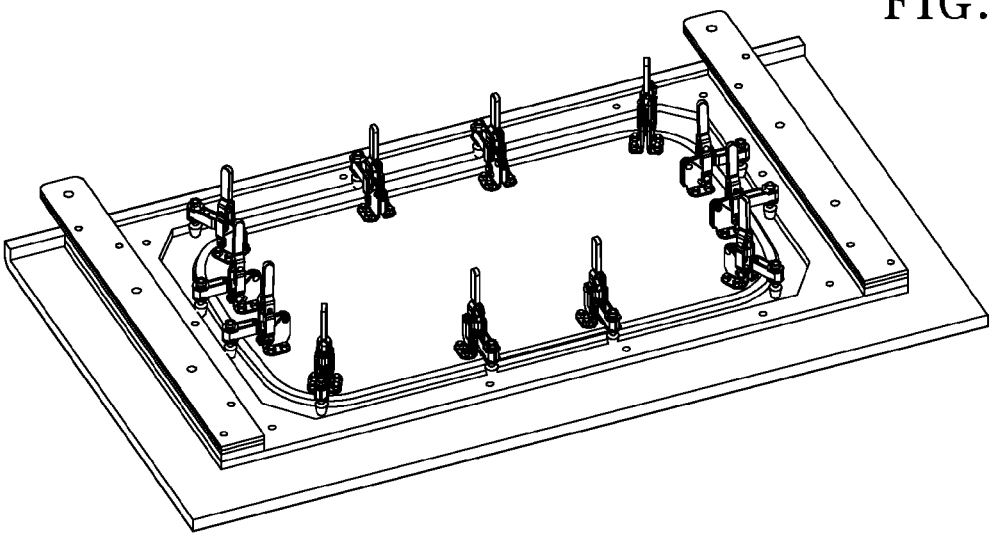
FIG. 16 is a top perspective view of an inverted countertop with a locator/dam ring and the mold installed.
Figure 17:
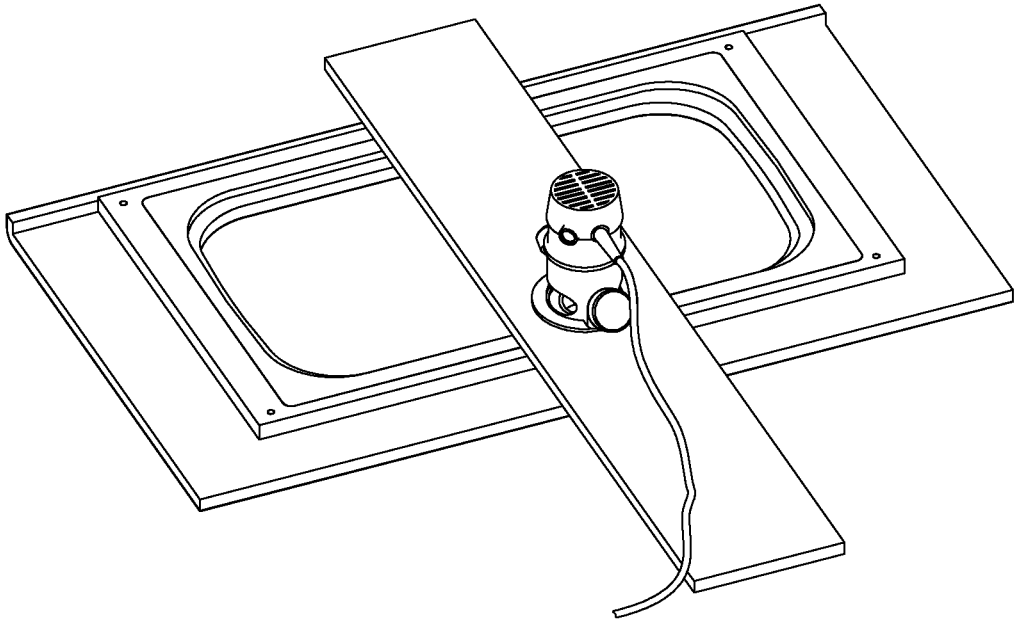
FIG. 17 is a top perspective of the surface routing jig, planing the exposed face of the seal with the inner ring installed.
Figure 18:
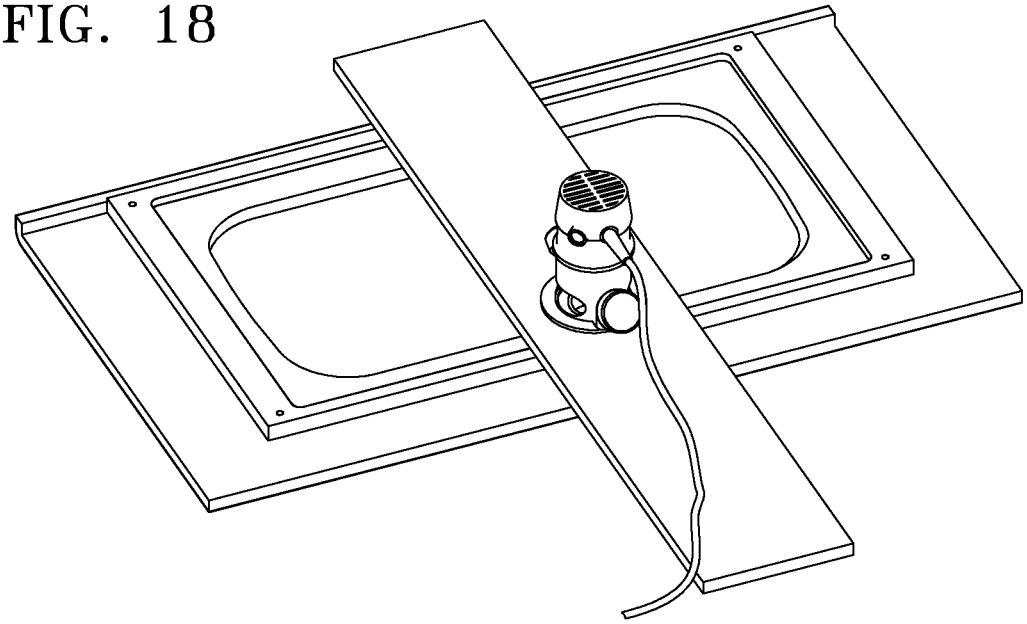
FIG. 18 is a top perspective of the surface routing jig planing the exposed face of the flange with the inner ring removed.
Figure 19:
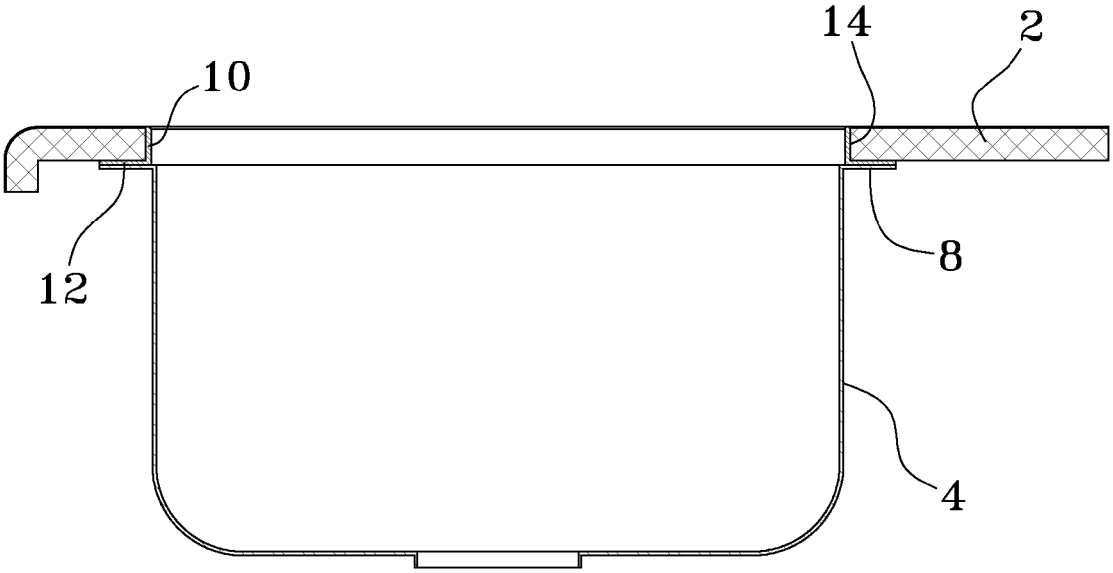
FIG. 19 is a side cross section of a laminate countertop with a seal and under counter mounted sink.

Looking at FIGS. 1, 2 and 19 the undermount sink seal can best be seen. A sink 4 is located such that all parts of the sink completely reside beneath a laminate countertop 2 (FIG. 9) and is physically held into place about numerous points of the bottom face of the sink flange 8 (FIG. 8) by a series of clamping assemblies 16 which are affixed to the bottom face of the countertop 2. A generally oval seal 10 having a planar flange 12 extending normally from its bottom edge is chemically bonded to the countertop 2 on the exposed edge of the sink cutout 14 and the bottom face of the countertop in an area matingly profiling that of the sink flange 8. It is to be noted that this seal 10 is chemically bonded directly to the cut edge of the laminate and the cut edge of the particle board substrate that the laminate is affixed to. By directly affixing the seal 10 to both of the parts that make up the countertop 2 there can be no leakage. Direct chemical affixation of the seal 10 means that the polymer of the seal 10 is bonded to the laminate and the particle board substrate without the use of any other material. It is the use of a polymer such as an epoxy, a polyester, a urethane, an acrylic or combination thereof that in the seal forming process bonds directly to the laminate and substrate. (The inclusion of such material would leave just another point of water leakage as in the prior art.) The flange 12 of the seal is surface planed to be parallel to the top of the sink flange 8 and to be of a uniform thickness with respect to the planar countertop. In this fashion when fully installed, no water can get between the sink 4 and the countertop 2, or contact the sink cutout.

The clamping assemblies 6 consist of clamp blocks 18 affixed to the bottom face of the countertop 2, which constrain arced metal clamping plates 16 that cantilever beyond the edge of the clamp blocks 18 and onto the bottom face of the sink flange 8. Short screws inserted through oblong slots in the center of the clamping plates 16 serve to tension upwardly the sink 4 onto the seal flange 12. (Alternatively inverted bolts may be secured under the clamp blocks 18 so as to leave threaded studs protruding normally from the exposed bottom face of the clamp block, onto which nuts could be threaded.) One edge of each of the clamp blocks 18 abuts an edge of the flange 12 on the seal 10. Since the clamp blocks 18 are thicker than the flange 12 this arrangement serves to define a positioning device for the placement of the sink 4 under the counter 2 such that the sink flange 8 resides directly atop the flange 12 on the seal.

With the seal flange 12, matingly configured to the sink flange 8 and planed to enable full surface contact between the sink and the flange, a watertight seal can be formed between the two with the inclusion of a sealant, especially since the sink 4 may be precisely located onto the seal flange 12 when installed by virtue of the placement of the clamp blocks 18 about the seal flange's periphery.

The seal 10 is made of a polymer epoxy resin so as to be economical, of minimal toxicity to work with, extremely resilient and quick to set up and cure. There is a plethora of materials that would work suitably as seal material but in the preferred embodiment an epoxy resin is used. Other suitable casting resin materials include but are not limited to polyester, polyurethane, epoxy and acrylic casting resins or any modified combination there of. The seal is poured in place as a liquid polymer into a mold around the sink cutout region so as to directly bond to the laminate and the particle board substrate of the countertop.

Prior art seals used with top mounted sinks notoriously let water contact the laminate substrate as most of them were glued or frictionally fit into place. They did not have an extended seal flange 12 and seal 10 that were chemically affixed (epoxied) to the entire countertop cutout, a seal flange 12 that extended over the entire top face of the sink flange 8, and a seal flange 12 that was matingly profiled to and planed parallel to the sink flange 8 so as to make a watertight seal. Additionally, the existing sink sealing systems did not have a physical positioning guide for the mounting of the sink precisely under their various seal arrangements.

The method of manufacturing the undermount sink seal utilizes a set of accurately dimensioned and interrelated jigs/templates including a locator/dam ring 20, a hole routing jig 22, a countertop cutout support jig 24, a seal mold 26, an inner routing ring 28, and a surface routing jig 30. A router 50 and a surface planing jig 52 are used for the cutting, trimming and surface planning operations. There are also the attendant mechanical fasteners, (preferably screws) as well as the polymer material used to make the sink seal, the silicon to bond the sink 2 to the seal flange 12, and the release products for the mold and the locator/dam ring. In the preferred embodiment these are carnauba wax and a spray release agent (commonly of a silicon variety.)

Figure 6:
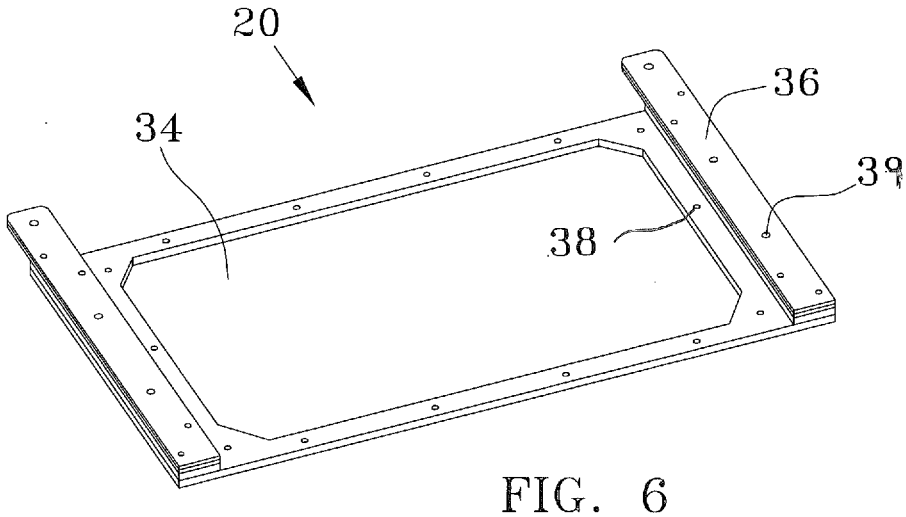
FIG. 6 is a top perspective view of the locator/dam ring.
Figure 20:
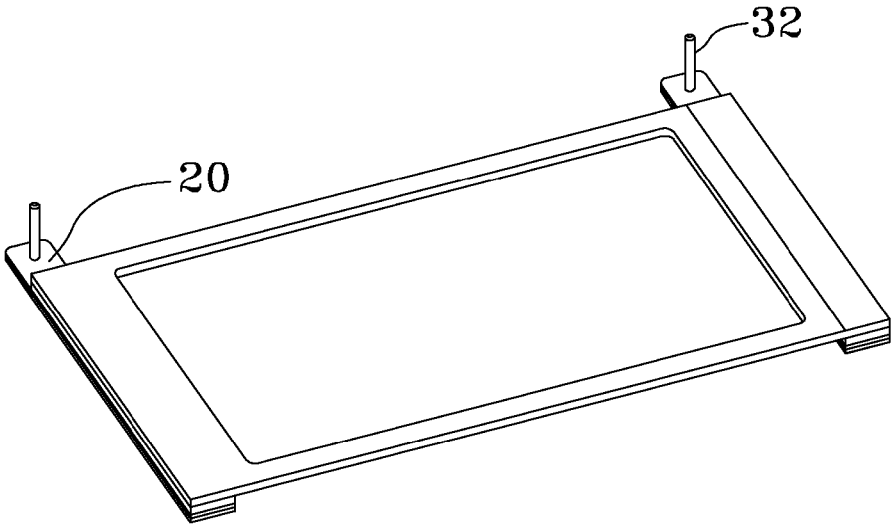
FIG. 20 is a bottom perspective view of the locator/dam ring showing the two positioning pins that extend therefrom.

The key component to making the seal 10 is the locator/dam ring 20 best seen in FIG. 6. It is this jig that is anchored to the countertop, thus establishing all the positioning for the various operations, and upon which all the other jigs attach to. The locator/dam ring 20 is a generally enclosed rectangular template with two positioning pins 32 extending therefrom that are used to align the other templates associated with the seal creation and affixation and planning (Reference FIG. 20 for an underside view.) It is dimensioned so that when its leading edge contacts the front lip of the countertop this will determine and set the depth onto the countertop 2 that the sink 4 will reside and ensure that the front and back sides of the hole routed through the countertop 2 for the sink 4 will lie perpendicular to the front and back edges of the countertop 2. The center cutout region of the locator/dam ring 34 has the same dimensions as the outside of the sink top flange 8. On the two short sides of the locator/dam ring 20 are template locating members 36 also used to position and affix the other jigs/templates. In these members 36 there are screw attachment orifices 38 that allow the passage of screws therethrough to secure the jig to the bottom face of the countertop.

Figure 5:
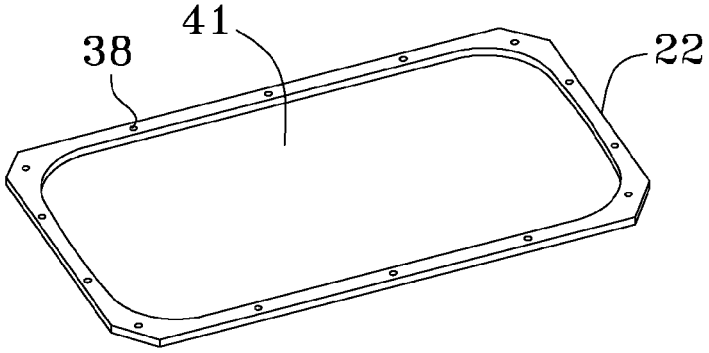
FIG. 5 is a top perspective view of the hole routing jig.

The hole routing jig 22 is best seen in FIG. 5. It is a rectangular template designed to tightly fit within the center cutout region of the locator/dam ring 34. The central cutout region of the hole routing jig 41 is matingly conformed to the sunken or concave region of the sink. There are also screw attachment orifices 38 that allow the passage of screws therethrough to secure it to the bottom face of the countertop 2.

Figure 7:
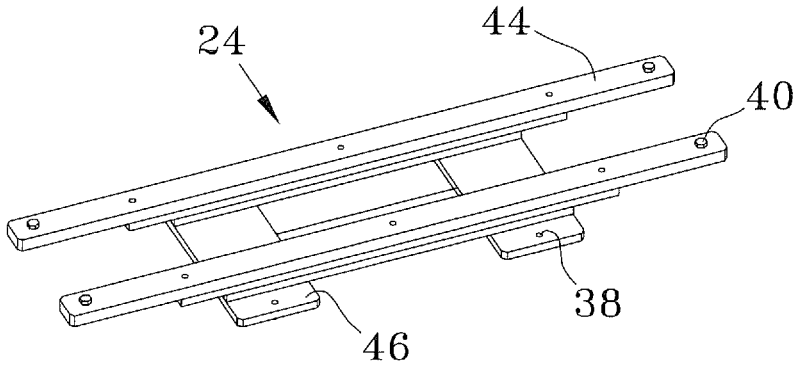
FIG. 7 is a top perspective view of the countertop cutout support jig.

The countertop cutout support jig 24 as best seen in FIG. 7 merely has a set of linear arms 44 that span the template locating members 36 and are affixed to them through screws 40 passing through the linear arm 44 and into t-nut attachment orifices 39 located on the underside of the locator/dam ring 20. Across the linear arms 44 are a pair of cutout arms 46 also having screw attachment orifices 38 that allow the linear arms 44 to be screwed to the countertop in the region to be cutout for the sink 2 installation.

FIG. 12 shows the locator/dam ring 20 with the hole routing jig 22 installed and the countertop cutout support jig 24 attached.

Looking at FIG. 10 the seal mold 26 can best be seen. It has a rectangular frame 54 that supports the mold form 56 and toggle pressure clamps 58. On two sides of the seal mold 26 are alignment strips 60 with locating orifices 62 formed therethrough. These locating orifices 62 are dimensionally sized to receive positioning pins 32 of the locator/dam ring 20. (The pins are visible in FIG. 13.) When the seal mold 26 is located beneath the countertop 2 and the pins 32 are inserted in the locating orifices 62, the seal mold 26 will be correctly aligned with the sink cutout such that the mold form 56 will extend through the sink cutout and the exterior profile of the mold form 56 will reside in a uniformly spaced placement about the periphery of the sink cutout. This is the gap or region into which the seal mold polymer resin will be poured and the sink seal 10 will be formed.

There is a series of toggle pressure clamps 58 positioned about the mold form 56 and mounted on the support backer plate 64. The clamp arms of these toggle pressure clamps 58 span across the gap onto the locator/dam ring 20 and when actuated serve to raise the mold form 56 into tight contact with the laminate countertop, thus allowing no seepage by of the seal material and resulting in a sharply defined interface between the countertop laminate and the seal 10. This is critical to both the visual aesthetics and the integrity of the waterproof seal at the laminate seal interface. In this manner there will be no seepage of seal material onto the top face of the countertop laminate.

The mold form 56 is made of polyurethane resin in the preferred embodiment as it works well with the preferred embodiment casting of the seal 10 with epoxy casting resin although room temperature vulcanizing (RTV) silicon has also been successfully used. The polyurethane resin of the mold generally will be of a low enough durometer so as to be flexible and slightly compressive. These features of the mold are critical as they allow the mold form 56 to be tightly fitted and compressed against the laminate countertop 2 so as to make a leak proof seal preventing the seal casting resin material from leaking out during fabrication of the seal 10, and securely maintaining the mold form 56 in its proper position.

Figure 4:
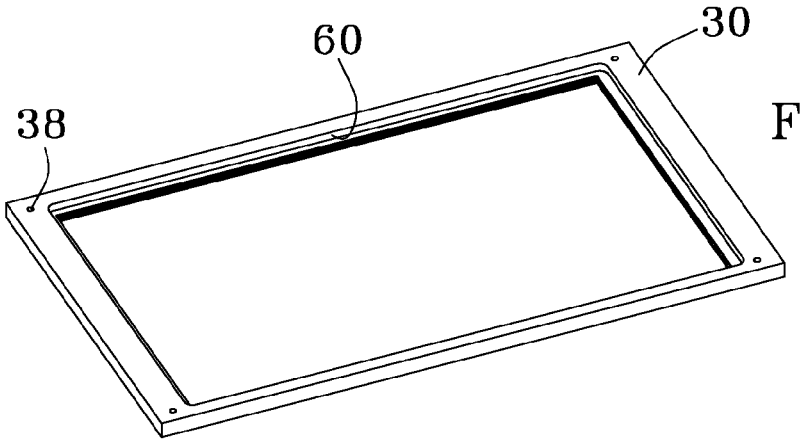
FIG. 4 is a top perspective view of the surface routing jig.

The surface routing jig 30 (FIG. 4) is a rectangular template with a recess on the bottom side which dimensionally matches the exterior dimensions or profile of the flange 8. It has screw attachment orifices 38 about it to allow it to be mechanically secured to the countertop 2. About its inner periphery is a rabbeted edge 60 that accepts the inner routing ring 28.

Figure 3:
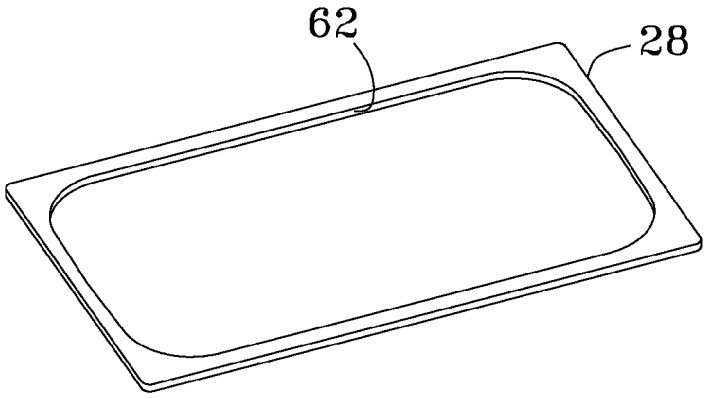
FIG. 3 is a top perspective view of the inner routing ring.

The inner routing ring 28, (FIG. 3) is a template sized for insertion into the surface routing jig 30. The outer profile of the inner routing ring 28 is matingly dimensioned and profiled to fit into the inner periphery of the surface routing jig 30. The inner profile of the inner routing ring 62 matches the profile of the outer edge of the seal 10.

FIG. 11 shows the router 50 attached to the surface routing spanner board 52. The spanner board is of a length sufficient to span over the sides of the surface routing jig 30, so as to maintain the cutting bit of the router at a constant height with respect to the bottom face of the laminate countertop. As is well known in the field of surface routing, a bushing is affixed at a uniform radius from the center of the cutting bit (affixed to either the spanner board or the router base.) This will allow precision locating when routing the surface as the bushing will contact the peripheral sides of the templates used in the surface routing process as described herein.

The mounting of the sink to the countertop uses the clamping assembly 6 detailed above and best illustrated in FIG. 2.

The steps to fabricating the sink seal as described above are as follows:

1. Paint a coat of release wax (preferably carnauba paste wax) on the underside and inside edge of the locator/dam ring 20 and allow sufficient time to dry. (Note it is only put onto the underside as a precaution if epoxy resin leaks under the rim.)
2. Spray RTV release bond onto the mold form 56 portion of the mold 26.
3. Lay the countertop 2 upside down so that the laminate surface is face down and the bottom face of the countertop 2 is facing upward. Place locator/dam ring 20 onto the bottom face of the countertop, ensuring the outside leading edge of the locator/dam ring 20 firmly contacts and abuts the inside edge of the front lip of the countertop 2. Slide the locator/dam ring 20 to the position where the sink 4 is to be located. Insert screws through the screw attachment orifices 38 located along the four sides of the locator/dam ring 20 and threadingly engage them into the bottom face of the laminate countertop 2 to secure the locator/dam ring 20 in its desired position. A screw should be used at numerous locations about all four sides to eliminate any movement of the locator/dam ring 20 during routing/placement operations. Before inserting screws the bottom face of the countertop should be center punched through the screw attachment orifices 38. This step allows the screws to go in perpendicular to the bottom face and completely parallel to the attachment orifices 38. Any angular insertion of a screw will distort the locator/dam ring's profile.
4. Insert the hole routing jig 22 into the locator/dam ring 20. These are close tolerance fits with the outside dimensions of the hole routing jig 22 approximating the inside dimensions of the locator/dam ring 20. Affix the hole routing jig 22 to the bottom face of the countertop 2 in the same fashion as was done with the locator/dam ring 20 above using screws through the screw attachment orifices 38.
5. Attach the countertop cutout support jig 24 to the locator/dam ring 20 by placing screws through screw attachment orifices 38 in the corners of the countertop cutout support jig 24 that pass through aligned screw attachment orifices 38 in the locator/dam ring 20. Attach the countertop cutout support jig 24 to the bottom face of the countertop 2 through the use of screws through the screw attachment orifices 38 as described above. The assembly of the locator/dam ring 20, the hole routing jig 22 and the countertop cutout support jig 24 is seen in FIG. 12. FIG. 14 shows this assembly mounted onto the countertop.
6. Drill a starting hole for the router bit through the countertop 2 within the area bounded by the inside of the locator/dam ring 20.
7. Install a flush cut straight router bit with a ⅛ inch diameter oversized guide bearing on the bottom. The guide bearing has a diameter that is ⅛ of an inch larger than the diameter of the flush cut bit. Flip the entire assembly over and insert the router bit through the starting hole so the router resides on the top surface of the counter. Route the sink opening out so that the center cutout of the countertop is no longer a contiguous section of the countertop as best seen in FIG. 13.
8. Remove the oversized guide bearing and install a size for size guide bearing on the bottom of the flush cut straight router bid. Reroute the sink opening. This step now removes the final 1⁄16 inch of countertop material and ensures the finish cut in the laminate countertop is extremely smooth. This step of double routing is key to getting a proper tight interface edge between the seal and the countertop. Aesthetically this will allow for a clean demarcation between the seal 10 and the countertop 2.

9. Flip the routed assembly over and remove the countertop cutout support 24 by removing screws 40 and lift the countertop cutout support 24 from the locator/dam ring 20 with the sink cutout still affixed to the countertop cutout support 24. The locator/dam ring 20 remains affixed to the countertop.
10. Remove the hole routing jig 22 by removing the screws and lifting it out of the locator/dam ring 20.
11. Spray silicon release wax onto the mold form 56. (All toggle clamps fully released.) Place the locator/dam ring 20 onto the mold 26 aligning the two into their critical nested spacing with the countertop 2 still attached and oriented face down. To accomplish this, there is a set of alignment pins 32 on the bottom face of the locator/dam ring 20 that engage in a set of mating locator orifices 62 in the mold 26. All of the numerous toggle (compression) clamps 58 about the periphery of the mold form 56 are engaged to frictionally contact the locator/dam ring 20. This step is critical to get a perfectly tight seal that does not allow any of the seal resin to leak by the cutout edge of the laminate countertop 2.
12. Mix the seal material as per manufacturer's directions adding pigment as necessary. Although the preferred embodiment uses an epoxy casting resin there is a plethora of other materials that may also be used to form the sink seal 10. Epoxy resin was chosen because of its long working times, hand mixing ability, low odor and volatile organic vapors.
13. Pour the epoxy into the annulus created between the mold form 56, the sink cutout in the countertop and the locator/dam ring 20. Let cure as per the manufacturer's directions.
14. Release all toggle pressure clamps 58 and lift the countertop 2 away from the mold 26 (with the locator/dam ring 20 still attached.) Remove the locator/dam ring 20 from the countertop 2 by removing the screws. (The counter sink hole now has an interior periphery epoxy seal ring 10 with an extended epoxy flange 12 formed on the bottom face of the counter.)
15. Place a surface routing jig 30 over the extended epoxy flange 12. The inside profile of the surface routing jig 30 dimensionally matches the exterior dimensions or profile of the extended epoxy flange 12. Attach a surface routing jig 30 onto the bottom face of the counter 2 with screws through screw attachment orifices 38. Place the inner routing ring 28 into the surface routing jig 30. The outer profile of the inner routing ring is matingly dimensioned and profiled to fit into the inner periphery of the surface routing jig 30. A router on a spanner board (FIG. 11) is used (as is well known in the industry) to allow the router bit to be held a constant depth off of the bottom face of the countertop. Counterclockwise rout the inside edge of the flange's 12 bottom face planar, tracing the inner routing ring.
16. Remove the inner routing ring 28 and then clockwise rout the outside edge of the of the flange 12. The entire seal 10 should now be a uniform thickness with respect to the bottom face of the counter and parallel to the sink flange 8. There should be no nicks in either of the edges of the flange 12.
17. Remove the surface routing jig 30.
18. Place the sink attachment blocks 6 directly abutting the extended epoxy flange 12. These are glued and screwed directly to the bottom face of the counter 2 with their embedded studs extending normally therefrom. These give a solid surface for the cantilever clips 16 to be secured into and serve as a locator for the sink placement for the in field installation of the sink.

In the field, the installer need just apply a suitable silicone or other sealant to the top face of the sink flange 8, raise the undermount sink 4 below the sink cutout aligning the edges of the sink 4 with the sides of the clamp blocks 6. The sink 4 is then propped up in place while a mechanical fastener is utilized in the slot of a clamping plate 16 and the clamping plate in tensioned until one end of the contacts the sink flange 8 and one end contacts the clamp block 6.

In an alternate embodiment, the seal 10 would be removably cast and hardened on a surface that had a profile that matched the sink cutout and the finished seal 10 would then be affixed to the sink cutout by an adhesive. The seal 10 in this case may be made to an extended height and once adhesively affixed to the sink cutout, routed down level with the top face of the laminate.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. A flanged seal for the mounting of an entirely under the countertop mounted sink comprising:

a generally oval ring having a top edge, a bottom edge, an inner face and an outer face wherein said inner face is chemically bonded to an inner sidewall of a sink cutout in a countertop so as to form a continuous watertight seal wherein said seal has a planar flange that extends to cover an area that only matingly profiles that of the sink flange, said planar flange having a top face and a bottom face, and said planar flange extends normally from said bottom edge of said ring and said top face is chemically bonded to a planar bottom face of said countertop in the region adjacent said sink cutout;

and wherein said flange bottom face is surface planed such that said bottom face is planar to and parallel to a top face of the mounting flange of a sink so as to create more surface contact between said sink and said seal.

2. The seal of claim 1 wherein said chemically bonded surfaces are affixed without the use of an adhesive.

3. The seal of claim 1 wherein said seal flange is a physical template for the placement of said sink such that there is full surface contact between the sink seal flange and the sink flange.

4. The seal of claim 3 wherein said seal is constructed from a polymer suitable casting resin material including but not limited to selected from the group consisting of polyester, polyurethane, epoxy and acrylic casting resins or any modified combination thereof.

5. The seal of claim 4 further comprising at least one clamping assembly mounted on a raised pad affixed to said bottom face of said countertop, said raised pad having a first dimension of thickness exceeding that second dimension of thickness of said flange lip planar flange thickness dimension, and said raised pad having a linear edge along one side that abuts an exterior edge of the peripheral profile of said flange lip planar flange.

6. A flanged seal adapted for the mounting of a completely under the countertop mounted sink comprising:

a generally oval ring having a top edge, an inner face, an outer face, and a flanged bottom having an upper face and a lower face that extends to cover an area that only matingly profiles that of the sink flange, wherein said inner face is continuously leakproof sealed to an inner sidewall of a sink cutout in a countertop and said inner face is chemically bonded to both an edge of a laminate and to an edge of the planar substrate that the laminate is affixed thereon, and said flanged bottom upper face is chemically bonded to a bottom face of said planar substrate in the region adjacent said sink cutout.

7. The flanged seal for an under countertop mounted sink of claim 6 wherein said flanged bottom is surface planed such that said bottom face is parallel to a top face of the mounting flange of a sink and to said bottom face of the countertop substrate.

8. The flanged seal for an under countertop mounted sink of claim 6 wherein said inner face is directly chemically affixed to both said edge of the laminate and said edge of the planar substrate that the laminate is affixed thereon as well as the said bottom face of the countertop substrate without the use of any adhesive.

* * * * *